US006719820B2

(12) United States Patent
Wolf et al.

(10) Patent No.: US 6,719,820 B2
(45) Date of Patent: Apr. 13, 2004

(54) AIR FILTER SYSTEM AND METHOD OF INSTALLATION

(76) Inventors: James Alan Wolf, 15310 Juniper Cove Dr., Cypress, TX (US) 77433; Jerry William Wolf, 31010 Johlke La., Magnolia, TX (US) 77355

( * ) Notice: Subject to any disclaimer, the term of this patent is extended or adjusted under 35 U.S.C. 154(b) by 0 days.

(21) Appl. No.: 10/365,104

(22) Filed: Feb. 12, 2003

(65) Prior Publication Data

US 2003/0211823 A1 Nov. 13, 2003

Related U.S. Application Data

(60) Provisional application No. 60/379,978, filed on May 13, 2002.

(51) Int. Cl.[7] ..... B01D 46/10

(52) U.S. Cl. ..... 55/496; 505/508; 505/DIG. 31

(58) Field of Search ..... 55/494, 496, 502, 55/505, 508, DIG. 31; 454/341, 306

(56) References Cited

U.S. PATENT DOCUMENTS 3,999,969 A * 12/1976 Shuler ..... 55/418
4,465,499 A * 8/1984 Wawro et al. ..... 55/481
5,695,535 A * 12/1997 Hintenlang et al. ..... 55/379

* cited by examiner

*Primary Examiner*—Harold Joyce
(74) *Attorney, Agent, or Firm*—The Matthews Firm

(57) ABSTRACT

A filter retaining apparatus and method for installing a thicker filter in an existing conventional return air duct in a conventional heating and air conditioning system. The filter is commercially available but is thicker than one conventionally used in such systems. A thicker filter provides more efficient air filtration and has a longer life, thus, requires less frequent cleaning or replacement. The retaining apparatus is capable of retaining the thicker filter and is adaptable to the existing return air duct opening without modification of the existing opening or the grill cover. The apparatus has the same length and width dimensions as the existing thin filter and is mounted on the same landing surface. The greater depth of the apparatus extends into the air duct. Thus, from the room interior it is not possible to detect the use of the apparatus. The greater depth of the apparatus retains the thicker commercially available filter. Another embodiment of the retaining apparatus, can be adapted to an existing return air duct that is somewhat shallower in depth while still retaining the commercially available thicker filter.

16 Claims, 7 Drawing Sheets

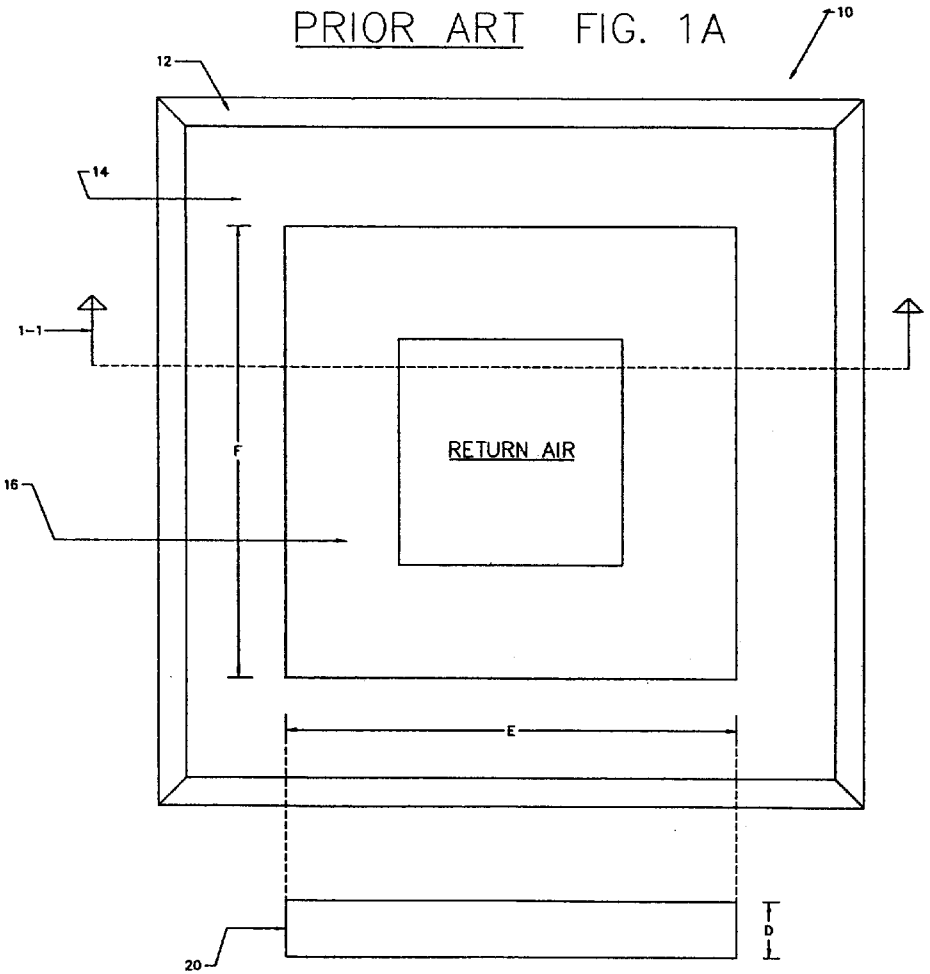
PRIOR ART FIG. 1A
PRIOR ART FIG. 2

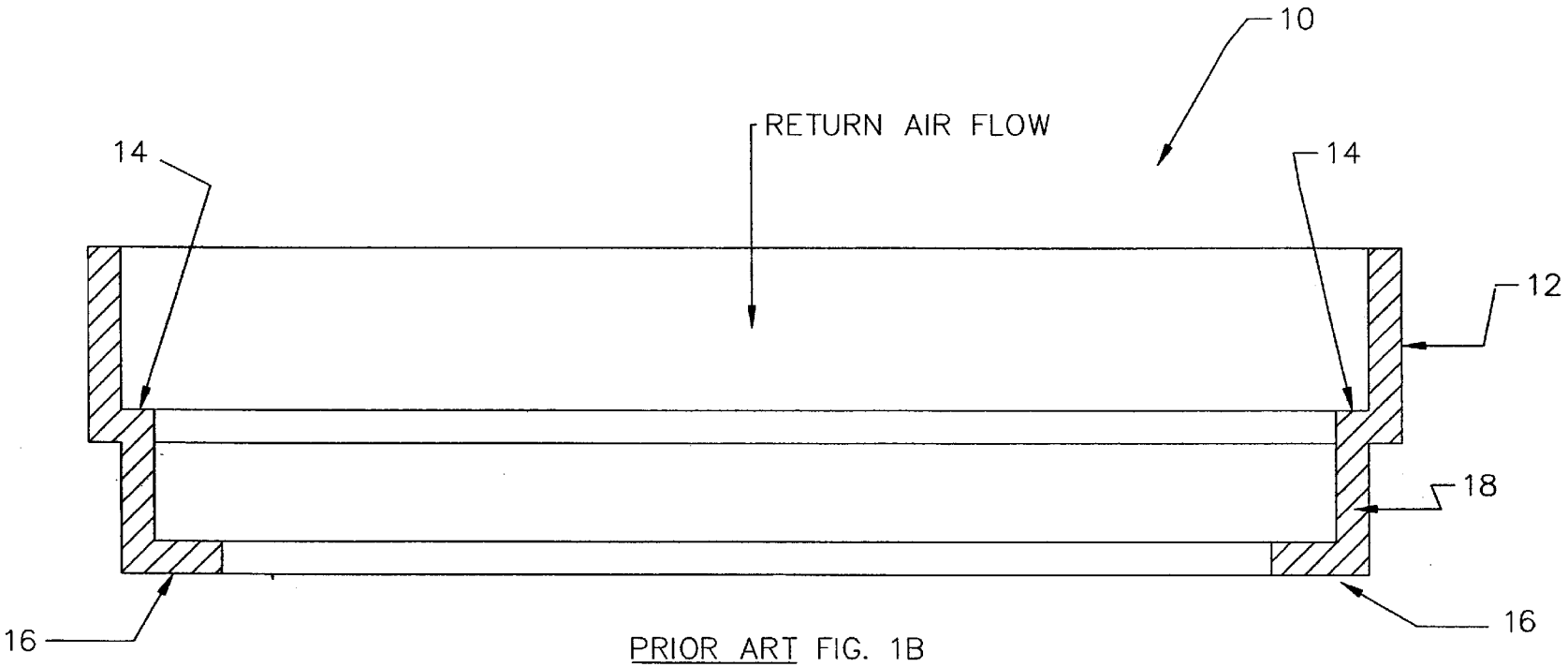
PRIOR ART FIG. 1B

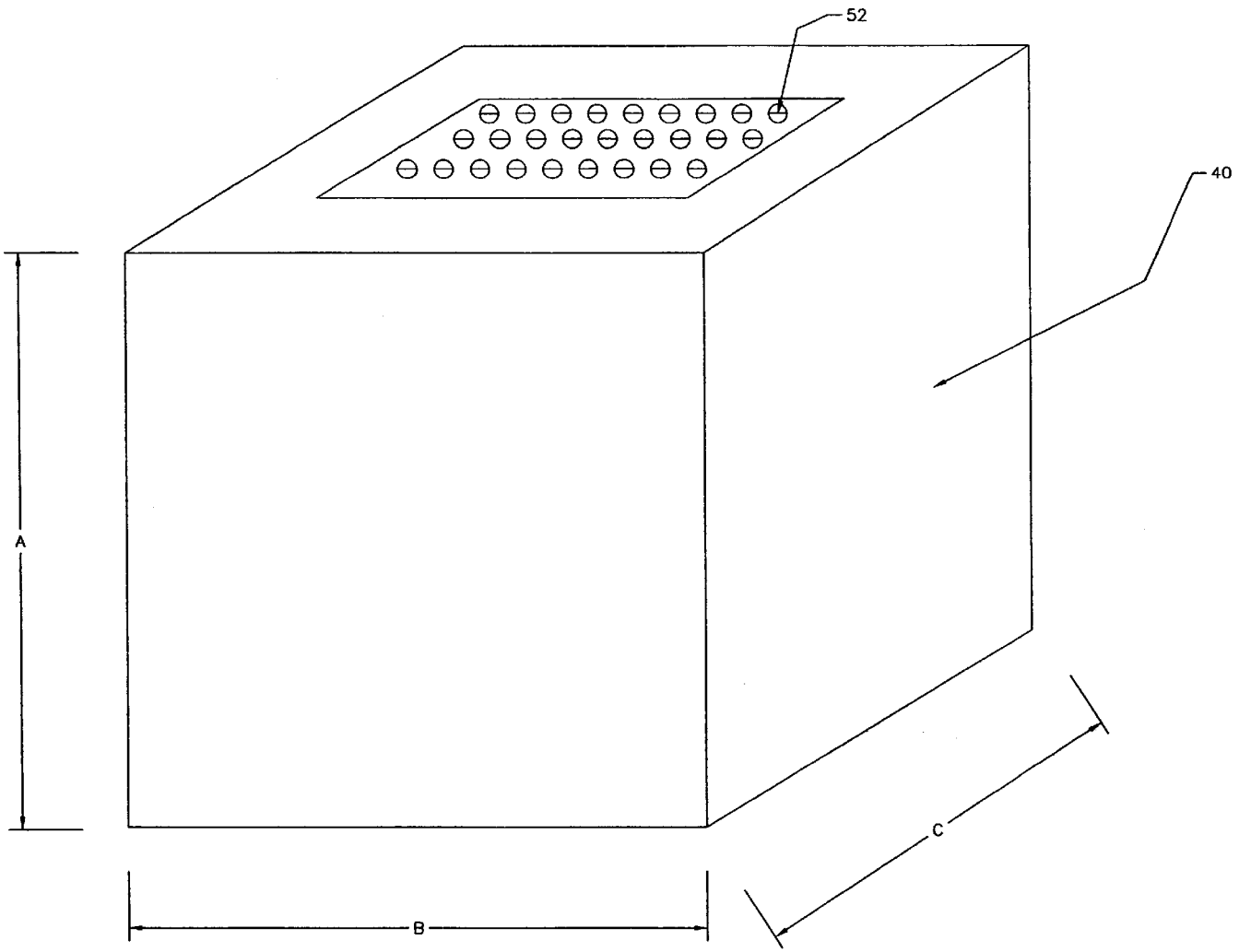
PRIOR ART FIG 4

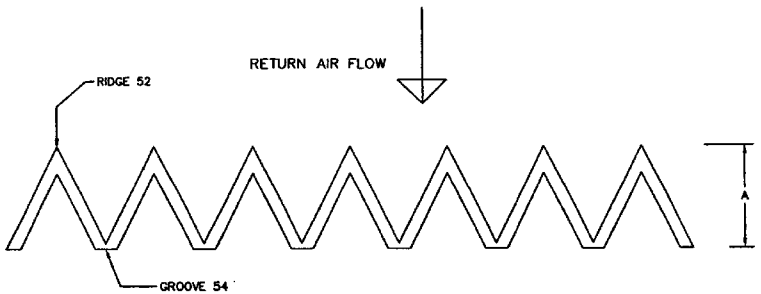
PRIOR ART FIG. 6
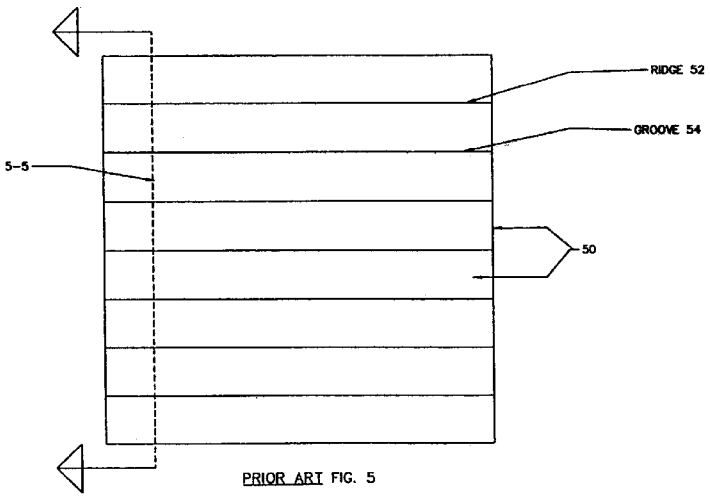
PRIOR ART FIG. 5

AIR FILTER SYSTEM AND METHOD OF INSTALLATION

RELATED APPLICATIONS

This application claims priority from U.S. Provisional Patent Application Ser. No. 60/379,978, filed May 13, 2002.

AREA OF TECHNOLOGY

The present apparatus relates, generally, to an air filter system used in air conditioning systems.

BACKGROUND OF THE INVENTION

In recent years, there has been a growing interest to improve the indoor air quality in homes and commercial buildings. One of the simplest ways to provide a certain level of improvement is through filtering the air circulated by conventional heating and air conditioning systems. The conventional heating and air conditioning system typically filters the intake air drawn into the system. Typically, the intake air duct is referred to as the return air duct. The intake is usually located on a wall or ceiling and covered by a grill or louver. The grill or louver cover usually fits in a frame, mounted in the wall or ceiling, which opens into the return air duct. Typically, the grill or louver cover is almost flush with the wall or ceiling to create an aesthetically pleasing appearance. In the conventional heating and air conditioning system, a filter will be set within the frame just behind the grill cover and held in place by the cover. However, to improve or maintain the air quality, the filter must remain clean. Thus, the filter requires periodic cleaning or replacement.

Presently, conventional return air filter systems utilize a filter that is approximately 1" in thickness. These filters vary in length and width depending on the size of the return air duct and the frame which opens into the room. The typical return air duct opening consists of wall or ceiling mounted frame that is configured to accept the 1" thick filter. Typically, the filter is held in place by a cover grill that fits in the wall or ceiling mounted apparatus. The cover grill can be hinged and is usually held closed by some type of fastener. The typical filter is readily available in a variety of lengths and widths.

One of the primary drawbacks of the 1" thick filter is that it requires cleaning and/or replacement often in less than one month of service. Although there are a variety of filter materials and filter element configurations available which may help increase the life of the filter by allowing relatively easy cleaning or prolonging the time between cleaning or replacing, the 1" thick filters are still limited in filtering efficiency. Thus, the requirement of frequent cleaning or replacement becomes an inconvenient chore resulting in the filters being used longer than recommended. This problem is even more compounded if, for instance, the return air opening is not easily accessible. The opening could be in a ceiling which cannot be reached without a ladder and thus in accessible to persons with age or physical limitations. The opening could also be placed in a small and confined space again limiting its access.

To overcome these disadvantages, a variety of devices have come about in this very crowded prior art field. The devices have ranged from installing filter containing frames on air intake grills as well as the outlet air grills. U.S. Pat. No. 6,361,578 discloses a filter within a frame that is attached onto the existing grill of an air vent issuing air into the room. Likewise, U.S. Pat. No. 5,947,815 discloses a filter within a frame that is attached to the outside of an existing grill of an air vent. The '578 patent discloses attachment by magnetic backing and the '815 patent discloses attachment to the grill by mounting brackets. Prior art, such as U.S. Pat. Nos. 5,863,310 and 6,030,427 disclose installing new frames into the wall or ceiling at the return air duct opening, thus, requiring the removal of any existing grill and framework. The prior art discloses a variety of easy to open grill covers ('578 patent), hinged covers ('310 patent and '427 patent) and even snap on covers (U.S. Pat. No. 4,334,899). Some of these devices are not flush with the wall or ceiling and thus could create other problems while other devices are flush mounted but included cumbersome installation. A common element of the prior art devices is that they include this filters which are usually 1" or less in thickness. However, no matter how easy the filter replacement becomes, the major disadvantage is still the thickness of the filter and its normally short efficient life of as little as one month.

One solution to this problem is the use of a thicker filter which would be much more efficient and would require less frequent cleaning or replacement. Currently, there are thicker filters available for return air systems. However, the conventional air return system is configured to only accept the 1" thick filter. Also, most of the prior art devices use a filter approximately 1" thick.

It is thus a desire to have an apparatus that can adapt the conventional air return system to accept a thicker filter. This desired apparatus should be easy to install and require a minimum amount of hardware. Preferably, this apparatus would fit inside the existing air duct wall or ceiling opening, require no modification of the existing frame, and utilize the existing grill cover without modification. Thus this apparatus should consist of a frame that can fit inside the existing return air duct frame into which the current 1" thick filter fits. This apparatus should be attached to the existing return air duct frame with sheet metal screws or other fasteners and be free from air leakage which would bypass the filter. This apparatus should further be able to accommodate the existing thicker air filters which are readily available and are approximately 4" thick. This thicker filter would be capable of efficient filtering for as long as one year at a time before requiring cleaning or replacement.

BRIEF DESCRIPTION OF THE DRAWINGS

FIG. 1A is a top plan view of a return air filter system in accordance with the prior art;

FIG. 1B is an elevated view, partly in cross-section, of the prior art system illustrated in FIG. 1A;

FIG. 2 is a side, elevated view of a conventional filter which is sized to reside within the prior art system illustrated in FIGS. 1A and 1B;

FIG. 4 is a pictorial view of a filter which can be used with the adaptor illustrated in FIGS. 3A, 3B, and 3C;

FIG. 5 is a top plan view of the filter material used with the filter illustrated in FIG. 4; and FIG. 6 is an elevated view of the filter material illustrated in FIG. 5, taken along the section line 5—5 of FIG. 5.

DETAILED DESCRIPTION OF THE PREFERRED EMBODIMENT

Figure 3A:
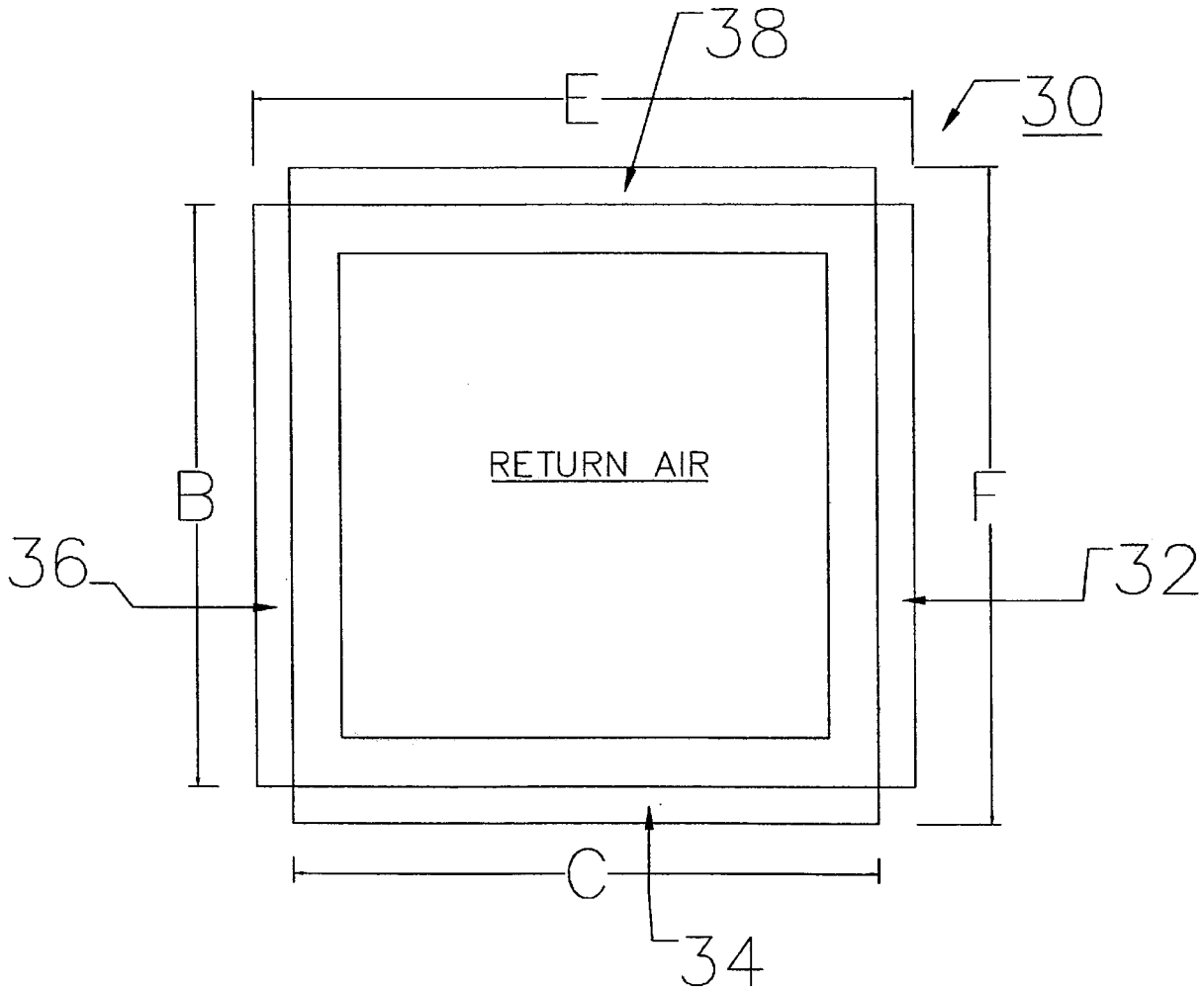
FIG. 3A is a top plan view of an adaptor in accordance with the present invention which can be used with the prior art system illustrated in FIGS. 1A and 1B.

Referring now to FIGS. 1A and 1B of the present invention, there is illustrated a top plan view of a conventional return air filter system 10 which has a lip 12 around the four sides of its perimeter. The unit 10 also has a first flat side 14 which is contiguous to the lip 12 and which also extends around the upper perimeter of the unit 10. As is well-known in the art of air conditioning air return systems, the surface 14 is typically used to provide a landing surface for a cover grill (not illustrated) which rests on top of the surface 14 after a clean filter has been inserted within the device 10. The grill may be hinged if desired and arranged to latch in the closed position to keep the clean filter within the unit. Alternatively, the grill may be attached over the surface 14 by the use of one or more threaded connections.

The unit 10 also has a surface 16 upon which the filter sets, with the surfaces 16 and 14 being interconnected by a vertically extended sidewall 18 with conventional air return units, the length of the wall 18 being nominally set at approximately 1 inch. The dimensions "E" and "F" will vary depending upon the unit but it is not uncommon for such units to be 20" to 25" (inches) on each side, so that when one goes into the store to buy a replacement filter, such a filter might have dimensions of 2"×25" and have a 1" (the "D" dimension of FIG. 2) thickness. Because filter 20 of FIG. 2 can typically only be 1" thick, such filters become dirty sometimes in no more than one month and have to be changed frequently. Moreover, because of the way in which the system is configured as in FIGS. 1A and 1B, filters not much thicker than approximately 1" cannot be used with such systems.

Referring now to FIG. 3A, there is illustrated a top plan view of an adaptor 30 which has dimensions which fit into the system 10 illustrated in FIGS. 1A and 1B. The surfaces 32, 34, 36 and 38 are sized to fit on the surfaces 16 in the prior art system illustrated in FIGS. 1A and 1B since the dimensions "E" and "F" in FIG. 3A are substantially identical to the dimensions "E" and "F" illustrated in FIG. 1A. As further illustrated in FIG. 3B, in the elevated view of the unit 30, the adaptor 30 has a sidewall 33 which provides a much greater depth filter than the sidewall 18 of FIG. 1B, thus allowing the filter 40 illustrated in FIG. 4 to be accommodated. The filter 40 has dimensions "B" and "C" which are essentially identical to the dimensions "B" and "C" shown in FIG. 3A of the adaptor 30. The dimension "A" of the filter 40 is essentially identical to the height of the sidewall 33, for example, four inches. By being able to use a much deeper filter such as on the filter 40, one can use a different type of filter material such as that illustrated in FIGS. 5 and 6. If desired, the filter 40 can be held in place within the adaptor 30 by using threaded fasteners, or by a small arm which can be rotated over the edge of the filter, or the like.

Referring now to FIG. 5, the pleated filter material 50 has a plurality of ridges 52 and grooves 54, which are illustrated as an elevated view in FIG. 6 taken along the section line 5—5 of FIG. 5. Such a filter is sometimes referred to as being pleated but also could be referred to as being corrugated in having its plurality of ridges 52 and grooves 54. Such filters are infinitely better than the 1" filters which have been used with the conventional, prior art air return systems such as are illustrated in FIGS. 1A and 1B.

Figure 3B:
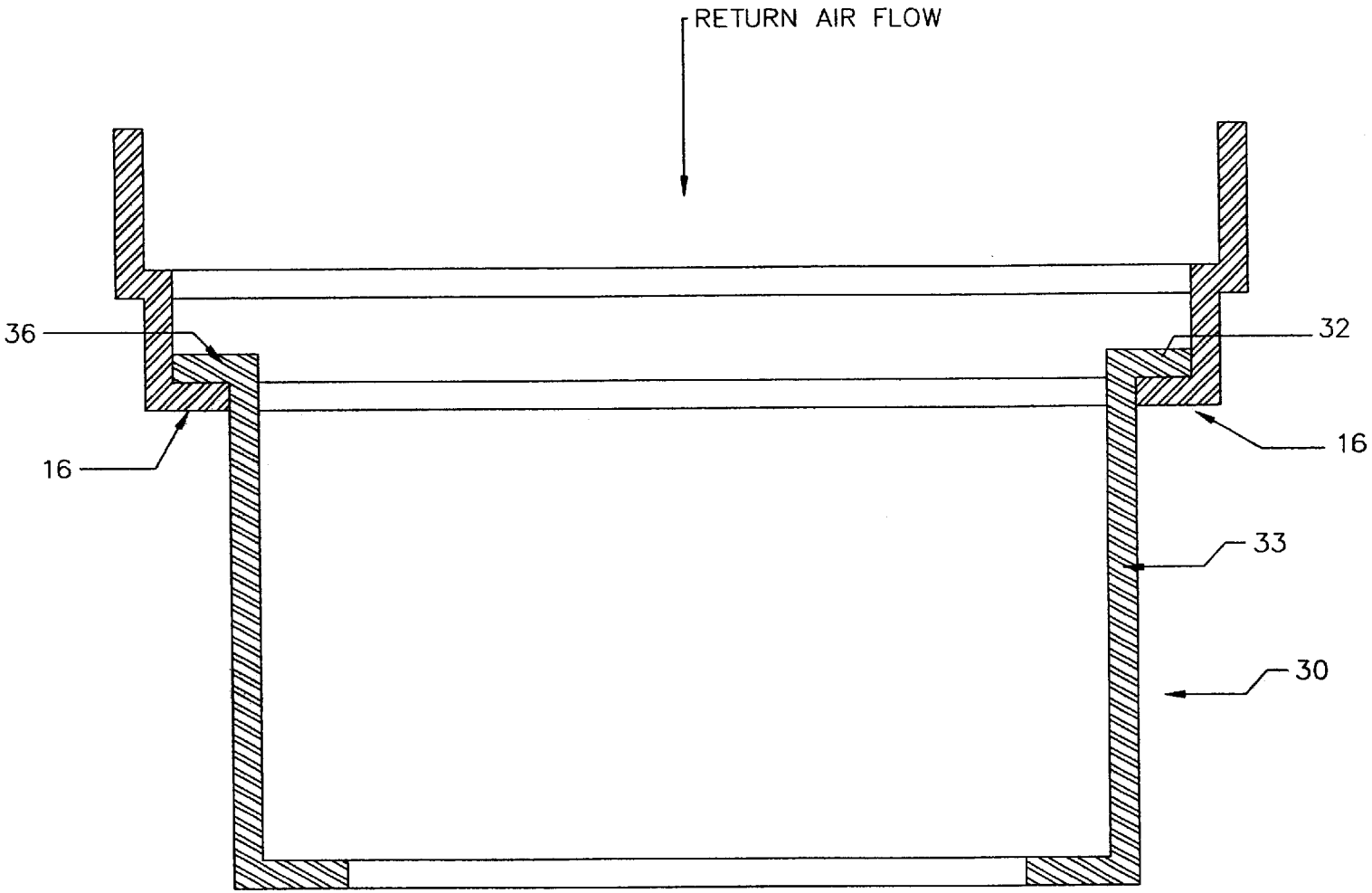
FIG. 3B is an elevated view, partly in cross-section, of the adaptor illustrated in FIG. 3A, used in conjunction with the prior art system illustrated in FIGS. 1A and 1B.

Simply by using the adaptor in accordance with FIGS. 3A and 3B, one can use filters which have greater depths, such as the one illustrated in FIG. 4, to provide clean return air to the air conditioning unit for as much as one year at a time, as contrasted with the 1" filters used with the prior art embodiment of FIGS. 1A and 1B which typically have to be cleaned or replaced within 1 or 2 months after being first used.

The adaptor 30 can be sealed in place within the unit 10, as illustrated in FIG. 3B by using tape, or a silicon sealer, or the like. In addition to the sealing, the adaptor 30 can be fixedly attached to the unit 10 by using one or more threaded fasteners between the plate having the surfaces 16 and the plates having the surfaces 32, 34, 36 and 38 illustrated in FIG. 3B.

Although the invention has been described above as relating to the use of an adaptor which enables the use of a 4" filter instead of a conventional 1" filter, the invention is not intended to be limited to those specific dimensions. By providing the adaptor in accordance with the present invention with a lip which rests where the prior art filter would normally have rested, one can make a filter used with the adaptor many times deeper than the prior art filters which have previously been used. Moreover, if desired, a second filter, for example, a 1" filter, can be placed right on top of the 4" filter and provide additional filtering if desired. The filter material for the 1" filter and the 4" filter can be the same, similar or different materials. This can be accomplished without doing anything other than merely placing the 1" filter on top of the upper lip surfaces 32, 34, 36 and 38, to thus allow the 1" filter and the 4" filter to be used in tandem.

Figure 3C:
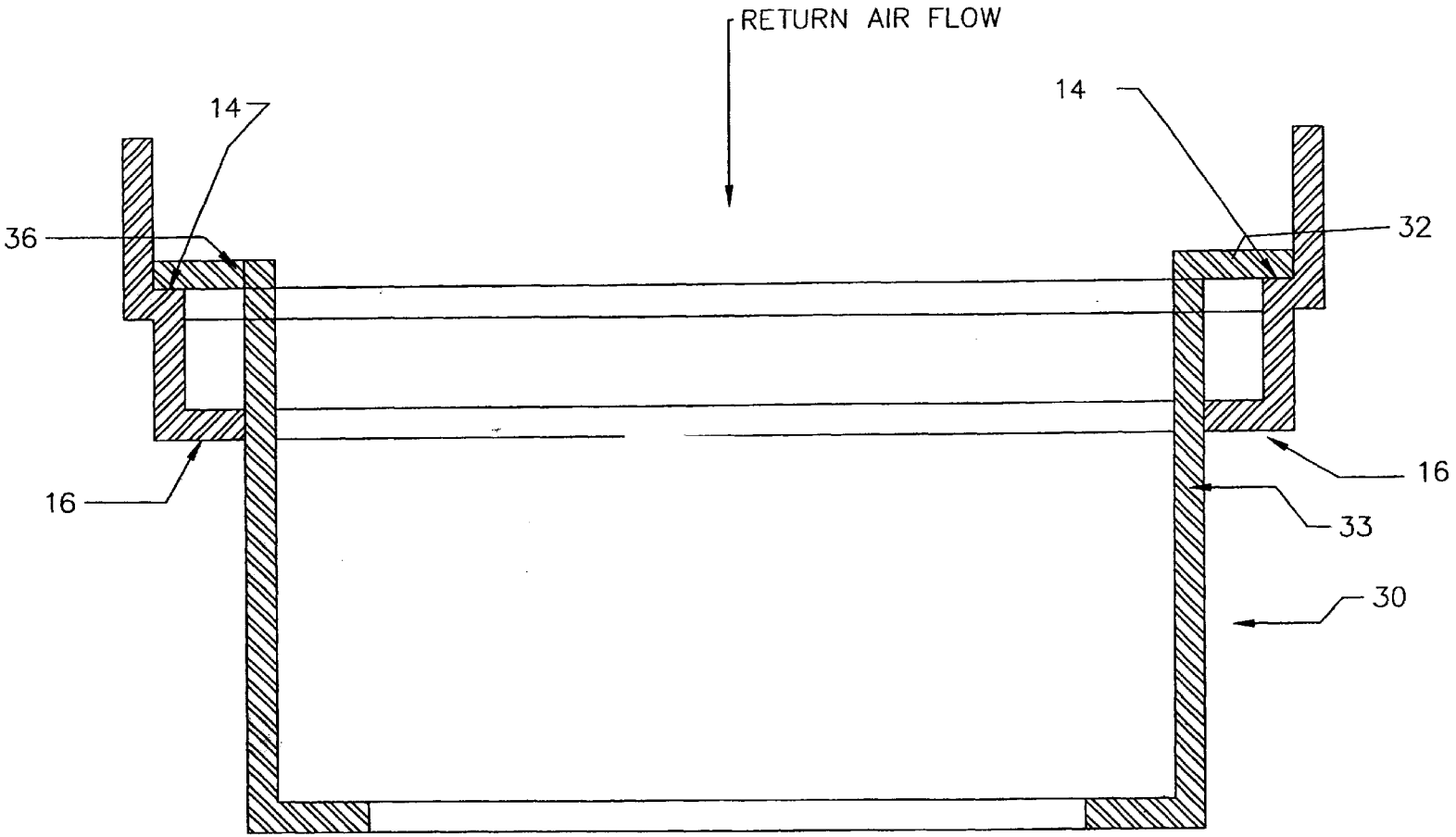
FIG. 3C is an alternative embodiment of the adaptor illustrated in FIG. 3B, used when space limitation prevents the use of an adaptor as illustrated in FIG. 3B.

FIG. 3C is an alternative embodiment of adaptor 30. This embodiment is used if there are space limitations, such as the depth of the air duct, which prevent insertion of adaptor 30 to a point where surfaces 32 and 36 rest on surface 16. In this alternative embodiment, surfaces 36 and 32 are extended so that when adaptor 30 is inserted surfaces 32 and 36 will rest on surface 14. This configuration, of adaptor 30 will still allow the use of the thicker air filter such as the one illustrated in FIG. 4.

Although this apparatus has been disclosed in relation to adaptation in an existing return air duct opening, it should be appreciated, by those in the art, that this device can be used for new construction as well as for air ducts which force air into a room. Similarly, the structure disclosed is primarily of a rectangular cross section since most conventional return air or issued air ducts terminate with an opening that is rectangular in cross section, however, it should be appreciated that other cross sectional configurations are possible. Moreover, it should be appreciated that some of the existing conventional return air ducts already are configured to accept filters thicker than 1", for example, 2", so the invention is not limited to the replacement of 1" filters. Moreover, the invention is not limited to the use of a 4 inch thick filter. The invention can be used with any thickness of filter, for example 2 inch, 3 inch, 4 inch, 5 inch, etc. , which uses the adaptors in accordance with this present invention.

What is claimed is:

1. An apparatus for retaining an air filter adaptor frame mounted inside an existing air return frame, disposed about a return air duct, said return air duct having a termination point in a wall, floor, or ceiling, comprising:

an air filter;

a first air return frame disposed about said termination point having a first landing area and a second landing area and a first extended sidewall and a second extended sidewall, an air filter adaptor frame having an inside and outside surface, a first end and a second end, a first flange disposed about the outer perimeter of said first end, and a second flange disposed about the inner perimeter of said second end; and said first flange disposed about the outer perimeter is mounted on said second landing area.

2. The apparatus of claim 1, wherein said adaptor frame is sized to fit within said first frame disposed about said return air duct termination point.

3. The apparatus of claim 1, wherein said air filter is sized to fit within said adaptor frame.

4. The apparatus of claim 1, wherein said first flange and said second flange maybe fixedly attached to said first end and said second end respectively.

5. The apparatus of claim 1, wherein said first flange and said second flange maybe integral to said first end and said second end respectively.

6. An apparatus for retaining an air filter adaptor frame mounted inside a return air duct, said return air duct having a termination point in a wall, floor, or ceiling, comprising:

an air filter;

a first frame disposed about said termination point having a first landing area and a second landing area and a first extended sidewall and a second extended sidewall, an air filter adaptor frame having an inside and outside surface, a first end and a second end, a first flange disposed about the outer perimeter of said first end, and a second flange disposed about the inner perimeter of said second end; and said flange disposed about the outer perimeter is mounted on said first landing area.

7. The apparatus of claim 6, wherein said adaptor frame is sized to fit within said first frame disposed about said return air duct termination point.

8. The apparatus of claim 6, wherein said air filter is sized to fit within said adaptor frame.

9. The apparatus of claim 6, wherein said first flange and said second flange maybe fixedly attached to said first end and said second end respectively.

10. The apparatus of claim 6, wherein said first flange and said second flange maybe integral to said first end and said second end respectively.

11. A method for installing an apparatus for retaining an air filter into a return air duct frame comprising steps of:

providing a return air duct terminating adjacent to a wall, floor, or ceiling;

providing a frame disposed about the termination point having a first landing area and a second landing area and a first extended sidewall and a second extended sidewall;

providing an air filter;

providing an air filter adaptor frame having an inside and outside surface, a first end and a second end, a first flange disposed about the outer perimeter of said first end, and a second flange disposed about the inner perimeter of said second end; and inserting said air filter adaptor frame into said existing frame disposed about said termination point until said first flange contacts said second landing area.

12. The method in claim 11, further including the step of:

providing a sealing means between the said first flange and said second landing area.

13. The method in claim 11, further including the steps of:

providing an attachment means for securing said air filter adaptor frame to said existing frame.

14. A method for installing an apparatus for retaining an air filter into a return air duct frame comprising steps of:

providing a return air duct terminating adjacent to a wall, floor, or ceiling;

providing a frame disposed about the termination point having a first landing area and a second landing area and a first extended sidewall and a second extended sidewall;

providing an air filter;

providing an air filter adaptor frame having an inside and outside surface, a first end and a second end, a first flange disposed about the outer perimeter of said first end, and a second flange disposed about the inner perimeter of said second end; and inserting said air filter adaptor frame into said existing frame disposed about said termination point until said first flange contacts said first landing area.

15. The method in claim 14, further including the step of:

providing a sealing means between the said first flange and said first landing area.

16. The method in claim 14, further including the steps of:

providing an attachment means for securing said air filter adaptor frame to said existing frame.

* * * * *